US005443670A

United States Patent [19]

Landau

[11] Patent Number: 5,443,670

[45] Date of Patent: Aug. 22, 1995

[54] METHOD FOR MAKING A BOUQUET WITH AN IMPROVED WRAP INCLUDING AN INTEGRAL RIBBON

[76] Inventor: Simcha Landau, 71 Garwood Rd., Fair Lawn, N.J. 07410

[21] Appl. No.: 53,307

[22] Filed: Apr. 26, 1993

Related U.S. Application Data

[63] Continuation of Ser. No. 602,756, Oct. 24, 1990, abandoned.

[51] Int. Cl.[6] ..... B65H 81/00

[52] U.S. Cl. ..... 156/191; 156/184; 156/247; 156/289; 428/41; 53/461; 24/5; 47/72

[58] Field of Search ..... 428/41, 23, 24, 194, 428/195, 220; 47/41.01, 72; 206/423, 45.33; 24/3 R, 5, 6; 53/397, 399, 461, 462, 465; 229/87.01, 87.06, 87.19; 156/184, 187, 191, 192

[56] References Cited

U.S. PATENT DOCUMENTS

| | | | |
|---|---|---|---|
| 1,044,260 | 11/1912 | Schloss | 206/423 |
| 1,446,563 | 2/1923 | Hughes | 47/72 |
| 1,996,066 | 4/1935 | Garling | 156/184 |
| 2,152,648 | 4/1939 | Jones | 47/72 |
| 2,247,191 | 6/1941 | Endres | 47/41.01 |
| 3,271,922 | 9/1966 | Wallerstein | 206/423 |
| 3,471,350 | 10/1969 | O'Berry et al. | 156/184 |
| 4,153,747 | 5/1979 | Young | 428/40 |
| 4,652,473 | 3/1987 | Han | 428/40 |
| 4,989,396 | 2/1991 | Weder | 53/462 |
| 5,007,229 | 4/1991 | Weder | 53/461 |
| 5,111,638 | 5/1992 | Weder | 53/462 |

FOREIGN PATENT DOCUMENTS

| | | | |
|---|---|---|---|
| 465696 | 4/1914 | France | 24/5 |
| 2633591 | 1/1990 | France | 206/423 |

*Primary Examiner*—David A. Simmons
*Assistant Examiner*—J. Sells
*Attorney, Agent, or Firm*—W. Patrick Quast

[57] ABSTRACT

A method of forming a flower bouquet for decorative use wherein the bouquet includes at least one flower and a conically shaped decorative wrap. The wrap is a sheet of transparent plastic material or paper with decorative designs. An end edge of the sheet has an adhesive strip layer. A peel-off ribbon, which initially covered the adhesive layer, encircles the conically shaped sheet with its ends tied together. A method of making the bouquet is also provided.

2 Claims, 2 Drawing Sheets

METHOD FOR MAKING A BOUQUET WITH AN IMPROVED WRAP INCLUDING AN INTEGRAL RIBBON

This application is a continuation of Ser. No. 07,602,756 filed Oct. 24, 1990, and now abandoned.

The invention generally relates to a flower bouquet, and in particular the invention relates to a flower bouquet which includes a wrap having an edge adhesive layer and having a peel-off ribbon for tying the wrap.

BACKGROUND OF THE INVENTION

The prior art flower bouquet includes flowers and includes a wrap having an edge adhesive layer.

One problem with the prior art flower bouquet is that the adhesive layer releases the wrap causing the wrap to unravel.

Further it is desirable to enhance the aesthetic appearance of the bouquet.

SUMMARY OF THE INVENTION

According to the present invention, a method of forming a flower bouquet is provided. This bouquet typically comprises a plurality of flowers with stems; a conical wrap having an outer surface and an inner surface; said inner surface having an end edge portion; said inner end edge portion having an elongate adhesive layer for affixing the wrap inner edge end portion to a portion of the wrap outer surface; and a peel-off ribbon for use as an initial cover over the adhesive layer and for use thereafter as a final tie around the wrap.

By using the peel-off ribbon as a final tie around the wrap, the frequency of unravelling is minimized plus a decorative touch is added to the bouquet.

The foregoing and other objects, features and advantages will be apparent from the following description of the preferred embodiment of the invention as illustrated in the accompanying drawings.

DESCRIPTION OF THE PREFERRED EMBODIMENT

Figure 1:
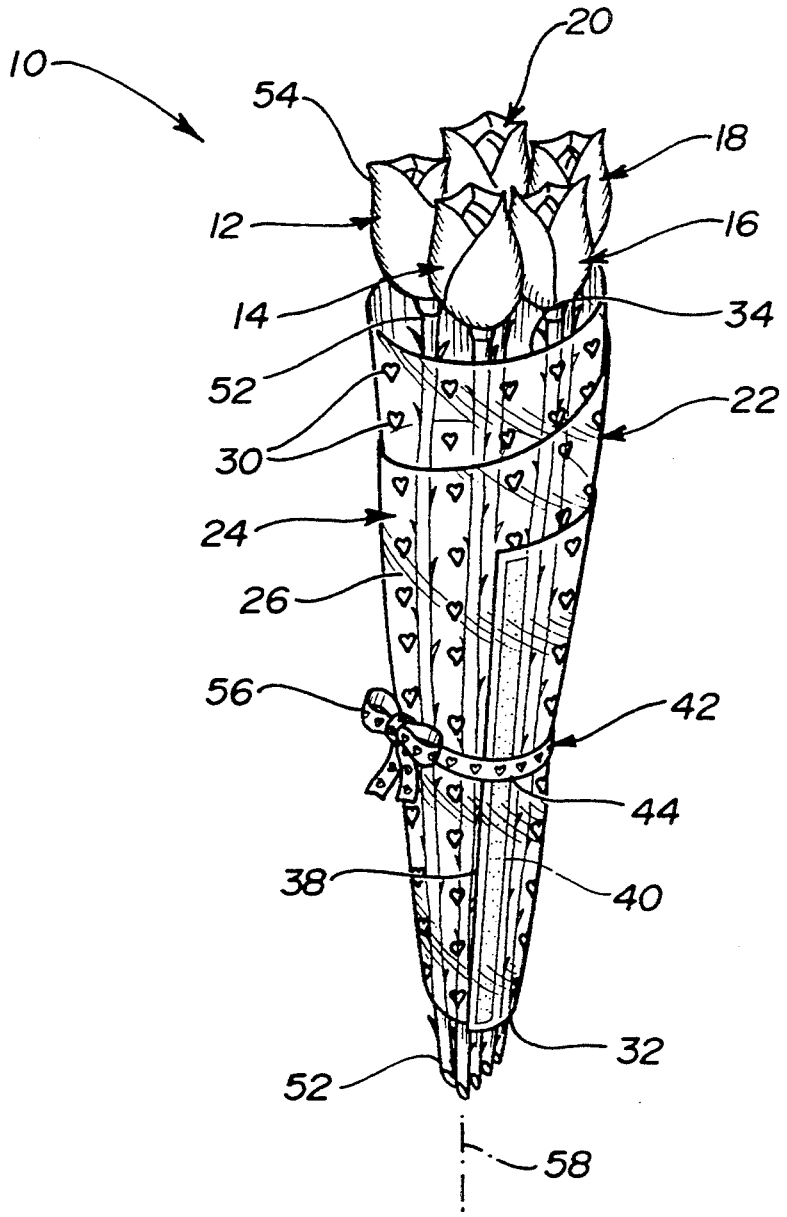
FIG. 1 is a perspective view of a flower bouquet according to the invention.
Figure 2:
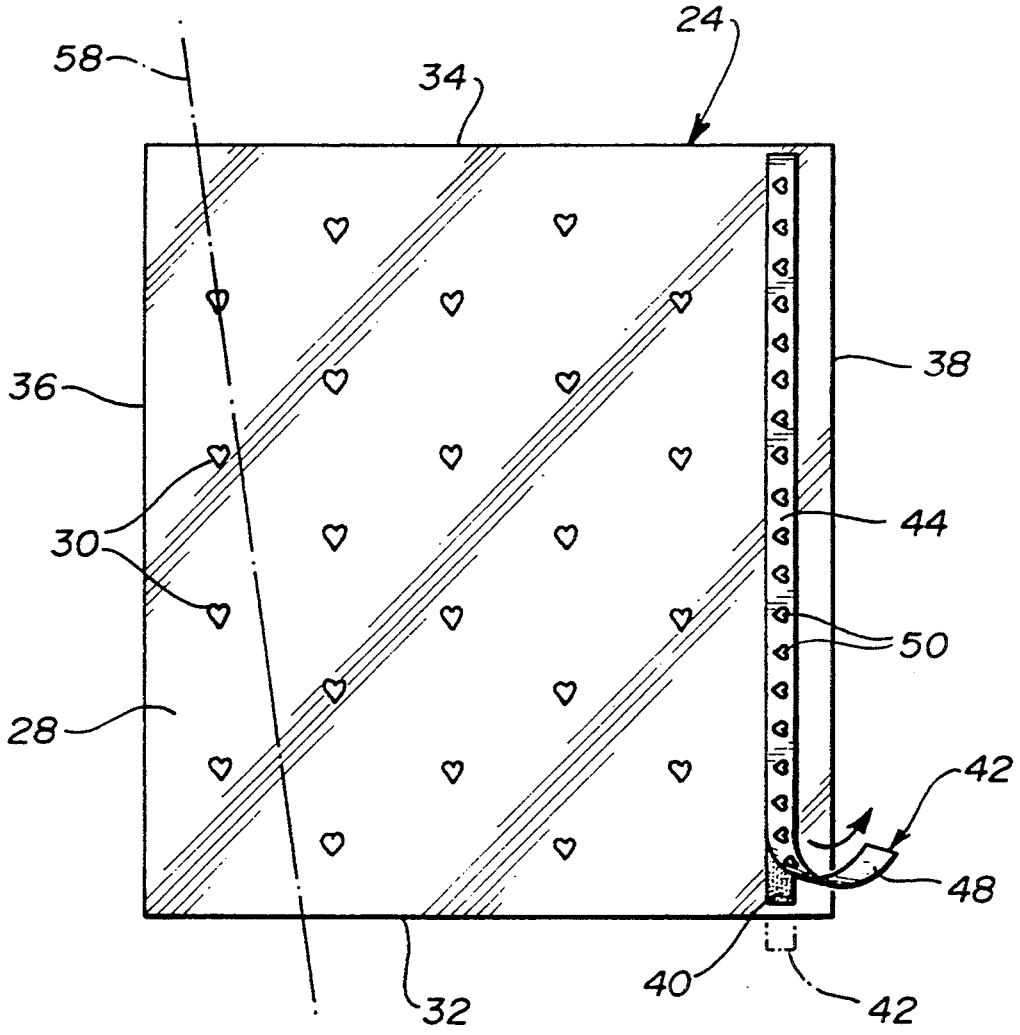
FIG. 2 is a developed plan view of a portion of the bouquet of FIG. 1.

As shown in FIGS. 1 and 2, flower bouquet 10 is provided. Bouquet 10 includes a plurality of flowers 12, 14, 16, 18, 20, and a wrap or wrapping 22.

Wrap 22 includes a sheet 24 which has an outer surface 26 and an inner surface 28. Outer surface 26 typically has a plurality of decorations or decorative indicia 30. When formed as part of the bouquet, sheet 24 as wrapped around the flowers, has a conical shape, which flares outwardly in an upward direction. Sheet 24 typically is composed of a transparent plastic material and is about 0.010 inches in thickness. Decorative designs or indicia 30 is printed on outer surface 26. Sheet 24, of course, could be fashioned from any wrapping material, including paper.

Sheet 24 has a bottom edge portion 32, a top edge portion 34, a left edge portion 36, and a right edge portion 38. Right edge portion 38 has an elongate layer of adhesive 40. Adhesive 40 is initially covered by a peel-off ribbon 42. Ribbon 42 typically is an elongate strip of plastic material, which typically is about 0.015 inches in thickness. Other materials that are used to make ribbons could also be used. Ribbon 42 has an outer surface 44 and an inner surface 48. Outer surface 44 has decorative forms or indicia 50. Top edge 34 may be straight or fluted or otherwise contoured to enhance the aesthetic appearance of the wrapped bouquet.

Typical flower 12 is substantially the same in structure as flowers 14, 16, 18, 20. Flower or flower unit 12 has a stalk or stem 52 and has a blossom or bloom 54. Ribbon 42 has a bow portion or bow 56, after ribbon 42 is tied around sheet 24 after it is formed conically as depicted in FIG. 1. Stems 52 are laid along roll line 58, for wrapping sheet 24 around stems 52. Line 58 is offset from surface 28 in FIG. 1.

The method of making bouquet 10 includes the steps as indicated hereafter.

First, lay sheet 24 in a substantially flat position having inner surface 28 facing upwardly.

Second, lay stems 52 of flowers 12, 14, 16, 18, 20 on sheet 24 as a group on a roll line 58 at an angle to left edge portion 36 having the line further away from left edge portion 36 at the bottom than at the top thereof.

Third, peel off ribbon 42 from adhesive layer 40 along right edge portion 38.

Fourth, wrap sheet 24 around stems 52 of flowers 12, 14, 16, 18, 20 in a conical shape with an upward flare.

Fifth, pull right edge portion 38 and press sheet outer surface 26 adjacent to right edge portion 38 and affix adhesive layer 40 to an aligning portion of sheet outer surface 26.

Sixth, encircle conically shaped sheet 24 with peel-off ribbon 42.

Seventh, tie ribbon 42 at ends thereof to form a bow 56.

The third step can be interposed at any point prior to the affixing of the adhesive layer 40 to a portion of sheet outer surface 26 as called for in the fifth step.

ADVANTAGES

An advantage of wrap 22 is that ribbon 42 can be tied around sheet 24 after peeling off ribbon 42 and wrapping sheet 24 and affixing adhesive layer 40, thereby minimizing the frequency of unravelling of sheet 24. Another advantage is that during the making of bouquet 10, the need for cutting a ribbon to tie around sheet 24 is avoided; and, of course, the aesthetic appearance of the bouquet is enhanced with the ribbon.

While the invention has been described in its preferred embodiment, it is to be understood that the words which have been used are words of description rather than limitation and that changes may be made within the purview of the appended claims without departing from the true scope and spirit of the invention in its broader aspects.

The embodiments of an invention in which an exclusive property or right is claimed are defined as follows:

1. A method of making a flower bouquet including the steps of: providing a decorative ribbon over an adhesive layer along an end portion of a sheet, said decorative ribbon protecting said adhesive laver;

peeling off said decorative ribbon from said adhesive layer , wrapping said sheet around the stem of at lest one flower in a conical shape with an upward flare;

pressing the sheet outer surface adjacent to said end edge portion and affixing said adhesive layer to a portion of said sheet outer surface;

encircling said conically shaped sheet with the peeled-off decorative ribbon; and tying the ends of said decorative ribbon together.

2. The method of claim 1, including the steps of:

with the decorative ribbon removed, laying said sheet in a substantially flat position having its inner surface face upwardly, said sheet having a left end edge portion and a right end edge portion; and laying the stem(s) of the flower(s) on said sheet as a group on a roll line at an angle to said left end edge portion having the line further away from said left end edge portion at the bottom of said left end edge portion than at the top thereof.

* * * * *